US010078303B2

(12) United States Patent
Kikushima

(10) Patent No.: US 10,078,303 B2
(45) Date of Patent: Sep. 18, 2018

(54) FIXING DEVICE AND IMAGE FORMING APPARATUS INCLUDING THE FIXING DEVICE

(71) Applicant: Yuuki Kikushima, Kanagawa (JP)

(72) Inventor: Yuuki Kikushima, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/369,592

(22) Filed: Dec. 5, 2016

(65) Prior Publication Data

US 2017/0168432 A1 Jun. 15, 2017

(30) Foreign Application Priority Data

Dec. 14, 2015 (JP) ..... 2015-242833

(51) Int. Cl.
*G03G 21/20* (2006.01)
*G03G 15/20* (2006.01)

(52) U.S. Cl.
CPC ..... *G03G 21/206* (2013.01); *G03G 15/2017* (2013.01); *G03G 2215/2032* (2013.01)

(58) Field of Classification Search
CPC ..... G03G 15/2017; G03G 15/2021; G03G 21/206
See application file for complete search history.

(56) References Cited

U.S. PATENT DOCUMENTS

2011/0222890 A1 9/2011 Kikushima et al.
2012/0328323 A1* 12/2012 Murooka ..... G03G 15/2017 399/92
2014/0199090 A1 7/2014 Kikushima
2015/0261183 A1 9/2015 Kikushima et al.

FOREIGN PATENT DOCUMENTS

JP 10-048981 2/1998
JP 2014-137487 7/2014
JP 2016-006472 1/2016

* cited by examiner

*Primary Examiner* — David M Gray
*Assistant Examiner* — Andrew V Do
(74) *Attorney, Agent, or Firm* — Duft Bornsen & Fettig LLP

(57) ABSTRACT

A fixing device includes a fixing rotator, a pressure rotator, a cooling assembly, and an air regulation plate. The cooling assembly blows air onto an outer circumferential face of the pressure rotator to cool the outer circumferential face of the pressure rotator. The air regulation plate is disposed opposing the outer circumferential face of the pressure rotator with a clearance between the air regulation plate and the outer circumferential face of the pressure rotator, to regulate a flow direction or amount of one of air to be blown onto the outer circumferential face of the pressure rotator and air having been blown onto the outer circumferential face of the pressure rotator. The air regulation plate has a leading end opposing the outer circumferential face of the pressure rotator. The leading end has a shape following the outer circumferential face of the pressure rotator.

7 Claims, 5 Drawing Sheets

FIXING DEVICE AND IMAGE FORMING APPARATUS INCLUDING THE FIXING DEVICE

CROSS-REFERENCE TO RELATED APPLICATIONS

This patent application is based on and claims priority pursuant to 35 U.S.C. § 119(a) to Japanese Patent Application No. 2015-242833, filed on Dec. 14, 2015, in the Japan Patent Office, the entire disclosure of which is hereby incorporated by reference herein.

BACKGROUND

Technical Field

Embodiments of the present disclosure relate to an image forming apparatus such as a copier, a printer, and a facsimile machine, or a multifunction peripheral of at least two of the foregoing capabilities, and a fixing device installed in the image forming apparatus.

Related Art

There has been conventionally known a technique of air-cooling the surface of a pressure roller (pressure rotator) provided in a fixing device installed in an image forming apparatus such as a copier and a printer, using a cooling assembly (cooling unit), for preventing such a failure that a surface temperature rise of the pressure roller generates a hot offset image, or heat expansion or heat deterioration of the pressure roller is caused.

For example, in a certain fixing device, a nip to which a recording medium is conveyed is formed by a pressure rotator such as a pressure roller and a pressure belt being pressed against a fixing rotator such as a fixing belt and a fixing roller. In addition, the recording medium is conveyed to a portion (corresponds to the nip) between the fixing rotator and the pressure rotator, where a toner image on the recording medium is fixed. Then, the cooling assembly (cooling unit) cools the pressure rotator by blowing air onto the outer circumferential face of the pressure rotator.

SUMMARY

In one aspect of the present disclosure, there is provided a fixing device that includes a fixing rotator, a pressure rotator, a cooling assembly, and an air regulation plate. The fixing rotator heats a toner image and fixes the toner image on a recording medium. The pressure rotator is pressed against the fixing rotator to form a nip between the pressure rotator and the fixing rotator, to which a recording medium is conveyed. The cooling assembly blows air onto an outer circumferential face of the pressure rotator to cool the outer circumferential face of the pressure rotator. The air regulation plate is disposed opposing the outer circumferential face of the pressure rotator with a clearance between the air regulation plate and the outer circumferential face of the pressure rotator, to regulate a flow direction or amount of one of air to be blown onto the outer circumferential face of the pressure rotator and air having been blown onto the outer circumferential face of the pressure rotator. The air regulation plate has a leading end opposing the outer circumferential face of the pressure rotator. The leading end has a shape following the outer circumferential face of the pressure rotator.

In another aspect of the present disclosure, there is provided an image forming apparatus that includes the fixing device.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
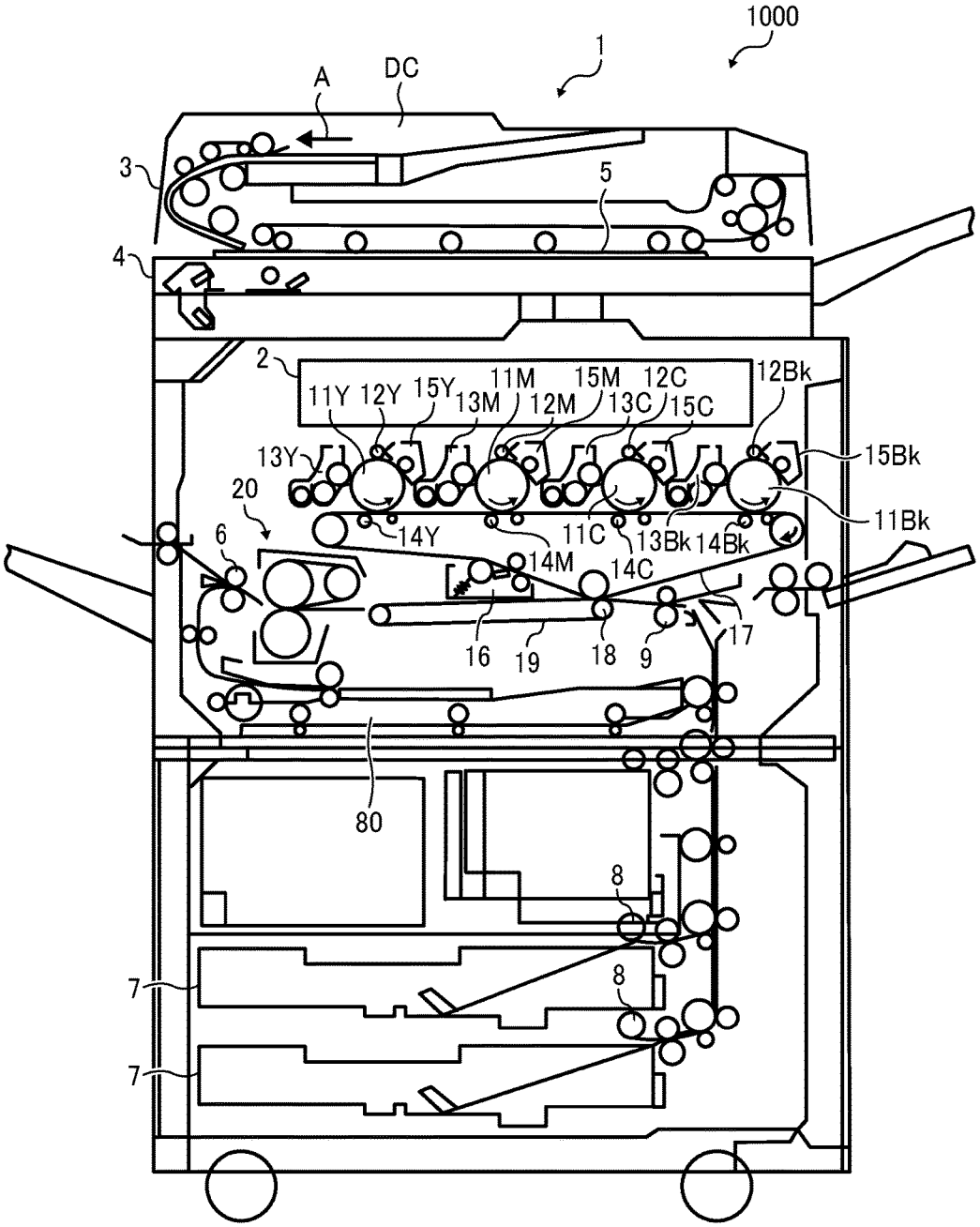
FIG. 1 is a general arrangement diagram illustrating an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Embodiments of the present disclosure will be described in detail below referring to the drawings. In addition, in the drawings, the same or corresponding parts are assigned the same signs, and the redundant descriptions thereof will be appropriately simplified or omitted.

First, general arrangement and operation of an image forming apparatus 1000 according to an embodiment of the present disclosure will be described referring to FIG. 1. In FIG. 1, the image forming apparatus 1000 is illustrated as a tandem color copier. The image forming apparatus 1000 includes a writing unit 2, a document conveyance unit 3, a document reading unit 4, paired conveyance rollers 6, a sheet feeding device (sheet feeding unit) 7, paired registration rollers 9, photoconductor drums 11Y, 11M, 11C, and 11BK (referred to as photoconductor drum(s) 11 unless distinguished), charging units 12Y, 12M, 12C, and 12BK (referred to as charging unit(s) 12 unless distinguished), developing units 13Y, 13M, 13C, and 13BK (referred to as developing unit(s) 13 unless distinguished), primary transfer bias rollers 14Y, 14M, 14C, and 14BK (referred to as primary transfer bias roller(s) 14 unless distinguished), and cleaning units 15Y, 15M, 15C, and 15BK (referred to as cleaning unit(s) 15 unless distinguished). The writing unit 2 emits laser light that is based on input image information. The document conveyance unit 3 conveys an original document DC to the document reading unit 4. The document reading unit 4 reads image information of the original document DC. The paired conveyance rollers 6 convey a recording medium P having been subjected to a fixing step. The sheet feeding device (sheet feeding unit) 7 stores the recording medium P (sheet of paper). The paired registration rollers 9 adjust a conveyance timing of the recording medium P. Toner images of the respective colors (yellow, magenta, cyan, and black) are formed on the photoconductor drums 11Y, 11M, 11C, and 11BK. The charging units 12Y, 12M, 12C, and 12BK charge the surfaces of the respective photoconductor drums 11Y, 11M, 11C, and 11BK. The developing units 13Y, 13M, 13C, and 13BK develop electrostatic latent images formed on the respective photoconductor drums 11Y, 11M, 11C, and 11BK. The primary transfer bias rollers 14Y, 14M, 14C, and 14BK transfer the toner images formed on the respective photoconductor drums 11Y, 11M, 11C, and 11BK, onto the recording medium P so as to be superimposed one on another. The cleaning units 15Y, 15M, 15C, and 15BK collect untransferred toner on the respective photoconductor drums 11Y, 11M, 11C, and 11BK.

In addition, the image forming apparatus 1000 includes an intermediate-transfer-belt cleaning unit 16, an intermediate transfer belt 17, a secondary transfer bias roller 18, a conveyance belt 19, a belt-type fixing device 20, and a duplex conveyance unit 80. The intermediate-transfer-belt cleaning unit 16 cleans the intermediate transfer belt 17. Toner images of a plurality of colors are transferred onto the intermediate transfer belt 17 so as to be superimposed one on another. The secondary transfer bias roller 18 transfers the color toner image on the intermediate transfer belt 17 onto the recording medium P. The conveyance belt 19 conveys the recording medium P having been subjected to a secondary transfer step, toward the fixing device 20. The fixing device 20 fixes the toner image (unfixed image) on the recording medium P. When duplex print is to be performed, the duplex conveyance unit 80 conveys the recording medium P of which printing on a front surface has ended, toward an image forming unit.

An operation in normal color image formation in the image forming apparatus 1000 will be described below. First, the original document DC is conveyed from a document table by a conveyance roller of the document conveyance unit 3, in a direction indicated by arrow A in FIG. 1, and placed on an exposure glass 5 of the document reading unit 4. Then, image information of the original document DC placed on the exposure glass 5 is optically read by the document reading unit 4.

Specifically, the document reading unit 4 scans while irradiating an image of the original document DC on the exposure glass 5, with light emitted from an illumination lamp. Then, light reflected on the original document DC passes through a set of mirrors and a lens so as to form an image on a color sensor. Color image information of the original document DC is converted into an electrical image signal after being read by the color sensor for each color separation light of RGB (red, green, and blue). Furthermore, based on a color separation image signal of RGB, an image processor performs processing such as color conversion processing, color correction processing, and spatial frequency correction processing, so that color image information pieces of yellow, magenta, cyan, and black are obtained.

Then, image information pieces of the respective colors of yellow, magenta, cyan, and black are transmitted to the writing unit 2. Then, laser light (exposure light) that is based on the image information of each color is emitted from the writing unit 2 onto a corresponding one of the photoconductor drums 11Y, 11M, 11C, and 11BK.

On the other hand, the 4 photoconductor drums 11Y, 11M, 11C, and 11BK each rotate in a counterclockwise direction in FIG. 1. Then, first, the surfaces of the photoconductor drums 11Y, 11M, 11C, and 11BK are uniformly charged in portions opposing the charging units 12Y, 12M, 12C, and 12BK (corresponds to a charging step.). In this manner, charge potentials are formed on the photoconductor drums 11Y, 11M, 11C, and 11BK. Then, the charged surfaces of the photoconductor drums 11Y, 11M, 11C, and 11BK reach irradiation positions of the respective laser lights. In the writing unit 2, laser lights corresponding to image signals are emitted from 4 light sources so as to correspond to the respective colors. Each laser light passes through a different light path for each color component of yellow, magenta, cyan, and black (corresponds to an exposure step.).

Laser light corresponding to a yellow component is emitted onto the surface of the photoconductor drum 11Y disposed first from a left side in a sheet face on which FIG. 1 is printed. At this time, the laser light corresponding to the yellow component is scanned in a rotation axis direction (main scanning direction) of the photoconductor drum 11Y by a rapidly-rotating polygon mirror. In this manner, an electrostatic latent image corresponding to the yellow component is formed on the photoconductor drum 11Y charged by the charging unit 12.

In a similar manner, laser light corresponding to a magenta component is emitted onto the surface of the photoconductor drum 11M disposed second from the left side in the sheet face on which FIG. 1 is printed, so that an electrostatic latent image corresponding to the magenta component is formed. Laser light corresponding to a cyan component is emitted onto the surface of the photoconductor drum 11C disposed third from the left side in the sheet face on which FIG. 1 is printed, so that an electrostatic latent image with the cyan component is formed. Laser light corresponding to a black component is emitted onto the surface of the photoconductor drum 11BK disposed fourth from the left side in the sheet face on which FIG. 1 is printed, so that an electrostatic latent image with the black component is formed.

Then, the surfaces of the photoconductor drums 11Y, 11M, 11C, and 11BK on which the electrostatic latent images of the respective colors are formed reach positions opposing the respective developing units 13Y, 13M, 13C, and 13BK. Then, toners of the respective colors are supplied from the respective developing units 13Y, 13M, 13C, and 13BK onto the photoconductor drums 11Y, 11M, 11C, and 11BK, so that the latent images on the photoconductor drums 11Y, 11M, 11C, and 11BK are developed (corresponds to a developing step.). Then, the surfaces of the photoconductor drums 11Y, 11M, 11C, and 11BK that have been subjected to the developing step reach the respective portions opposing the intermediate transfer belt 17. Here, the primary transfer bias rollers 14Y, 14M, 14C, and 14BK are installed on the respective opposing portions so as to be in contact with the inner circumferential face of the intermediate transfer belt 17. Then, in the positions of the primary transfer bias rollers 14Y, 14M, 14C, and 14BK, the toner images of the respective colors that are formed on the photoconductor drums 11Y, 11M, 11C, and 11BK are sequentially transferred onto the intermediate transfer belt 17 and superimposed one on another (corresponds to a primary transfer step.).

Then, the surfaces of the photoconductor drums 11Y, 11M, 11C, and 11BK that have been subjected to the transfer step reach the respective positions opposing the cleaning units 15Y, 15M, 15C, and 15BK. Then, the cleaning units 15Y, 15M, 15C, and 15BK collect untransferred toner remaining on the photoconductor drums 11Y, 11M, 11C, and 11BK (corresponds to a cleaning step.). Then, the surfaces of the photoconductor drums 11Y, 11M, 11C, and 11BK pass through an electric discharging unit, so that a series of image formation processes in the photoconductor drums 11Y, 11M, 11C, and 11BK ends.

On the other hand, the intermediate transfer belt 17 on which the toners of the respective colors on the photoconductor drums 11Y, 11M, 11C, and 11BK are transferred (borne) so as to be superimposed one on another travels in a clockwise direction in FIG. 1, to reach a position opposing the secondary transfer bias roller 18. Then, in the position opposing the secondary transfer bias roller 18, the color toner image borne on the intermediate transfer belt 17 is transferred onto the recording medium P (corresponds to a secondary transfer step.). Then, the surface of the intermediate transfer belt 17 reaches the position of the intermediate-transfer-belt cleaning unit 16. Then, untransferred toner adhering onto the intermediate transfer belt 17 is collected by the intermediate-transfer-belt cleaning unit 16, so that a series of transfer processes in the intermediate transfer belt 17 ends.

Here, the recording medium P conveyed to a portion (corresponds to a secondary transfer nip.) between the intermediate transfer belt 17 and the secondary transfer bias roller 18 has been conveyed from the sheet feeding device 7 via the paired registration rollers 9 and the like. Specifically, the recording medium P fed by a sheet feeding roller 8 from the sheet feeding device 7 storing the recording medium P is guided to the paired registration rollers 9 after having passed through a conveyance guide. The recording medium P that has reached the paired registration rollers 9 (timing rollers) is conveyed toward the secondary transfer nip at an appropriate timing.

Then, the recording medium P on which a full color image has been transferred is guided by the conveyance belt 19 to the fixing device 20. In the fixing device 20, at a nip between a fixing belt and a pressure roller, the color image (toner) is fixed onto the recording medium P (corresponds to the fixing step.). Then, the recording medium P having been subjected to the fixing step is conveyed by the paired conveyance rollers 6, and then, ejected by paired ejection rollers to the outside of the apparatus body 1 as an output image, so that a series of image formation processes is completed.

In addition, if a "duplex print mode" in which printing is performed on the both surfaces (correspond to the front surface and the rear surface.) of the recording medium P is selected, the recording medium P of which the fixing step for the front surface has ended is guided to the duplex conveyance unit 80 without being directly ejected. In the duplex conveyance unit 80, a conveyance direction is inverted, and then, the recording medium P is conveyed again toward the position of the secondary transfer bias roller 18. Then, in the position of the secondary transfer bias roller 18, image formation is performed on the rear surface of the recording medium P through an image forming process similar to the process described above. Then, after being subjected to the fixing step in the fixing device 20 and being conveyed by the paired conveyance rollers 6, the recording medium P is ejected by the paired ejection rollers to the outside of the apparatus body 1 as an output image.

Figure 2:
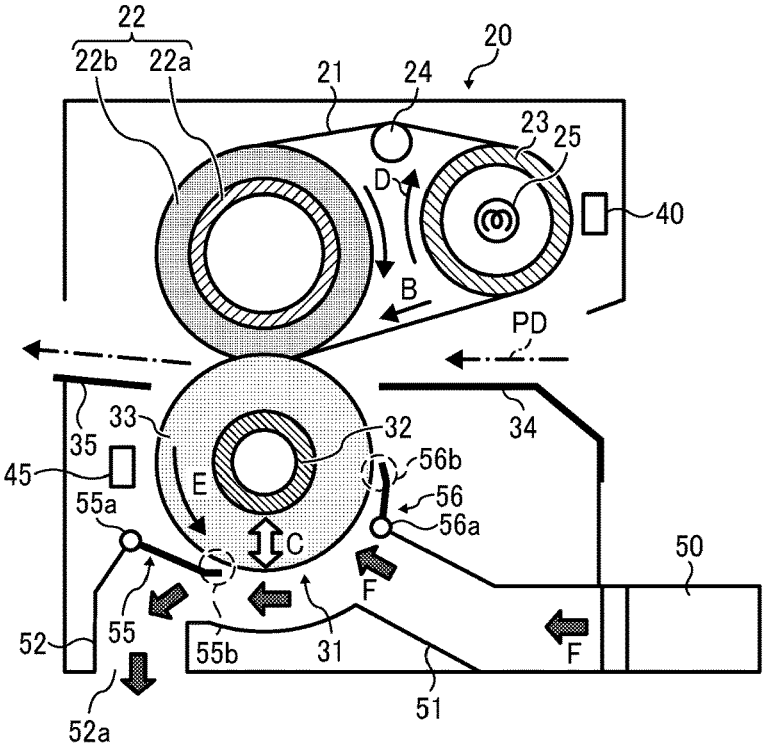
FIG. 2 is a configuration diagram illustrating a fixing device according to an embodiment of the present disclosure.

Next, the configuration and the operation of the fixing device 20 installed in the apparatus body 1 will be described in detail referring to FIG. 2. As illustrated in FIG. 2, the fixing device 20 includes a fixing assist roller 22, a heating roller 23, a fixing belt 21 serving as a fixing rotator, a tension roller 24, a pressure roller 31 serving as a pressure rotator, a temperature sensor 40 for the fixing belt 21, a temperature sensor 45 (temperature detector) for the pressure roller 31, an entry guide plate 34, an exit guide plate 35, a cooling assembly 500, air regulation plates 55 and 56, a moving assembly 60 (see FIG. 3.), and the like.

Here, the fixing belt 21 serving as a fixing rotator is a multilayered endless belt on which an elastic layer and a release layer are sequentially stacked on a base layer made of resin material. The elastic layer of the fixing belt 21 is made of elastic material such as fluorine-containing rubber, silicone rubber, and silicone foam rubber. The release layer of the fixing belt 21 is made of 4 fluorinated ethylene perfluoroalkyl vinyl ether copolymer resin (PFA), polyimide, polyetherimide, polyether sulfide (PES), and the like. By providing the release layer on the surface layer of the fixing belt 21, releasability (detachability) with respect to toner (toner image) is ensured. The fixing belt 21 travels (rotates) in a direction indicated by arrow B in FIG. 2 with being stretched around and supported by 3 rollers (correspond to the fixing assist roller 22, the heating roller 23, and the tension roller 24.). The tension roller 24 is in contact with the inner circumferential face of the fixing belt 21, and applies predetermined tensional force to the fixing belt 21. By using the fixing belt 21 with low heat capacity as a fixing rotator, the temperature rising property of the device increases.

The fixing assist roller 22 is a roller in which an elastic layer 22*b* (having asker C hardness of about 25 to 50.) made of silicone foam rubber with a layer thickness of about 15 mm is formed on a cored bar 22*a* such as SUS304, and forms a nip by being pressed against the pressure roller 31 serving as a pressure rotator, via the fixing belt 21. By forming the elastic layer 22*b* by foam material, a nip width (nip amount) of the nip can be set to be relatively large, and the heat of the fixing belt 21 becomes difficult to be transferred to the fixing assist roller 22. A shaft portion of the fixing assist roller 22 is coupled to a drive motor, and the fixing assist roller 22 is driven to rotate in a clockwise direction in FIG. 2. In addition, in the present embodiment, silicone foam rubber is used as the material of the elastic layer 22*b*. Alternatively, fluorine-containing rubber, silicone rubber, or the like can be used as the material of the elastic layer 22*b*.

The heating roller 23 is a hollow-structured roller made of metal material having high heat thermal conductivity, such as aluminum. A heater 25 (heat source) serving as a heater is fixedly installed on the inside of the cylindrical body of the heating roller 23. In addition, alumite treatment is applied to the surface of the heating roller 23 for enhancing corrosion resistance. The heater 25 of the heating roller 23 is a halogen heater, and the both ends thereof are secured on the side plates of the fixing device 20. Then, the heating roller 23 is heated by radiation heat from the heater 25 output-controlled by a power source (an alternating-current power source) installed in the apparatus body 1. Furthermore, heat is added to the toner image on the recording medium P from the surface of the fixing belt 21 heated by the heating roller 23. The output control of the heater 25 (heater) is performed based on a detection result of a belt surface temperature that is obtained by the temperature sensor 40 (thermopile) opposing the surface of the fixing belt 21 in a non-contact manner. Specifically, alternating current voltage is applied from the power source to the heater 25 for a power supply time defined based on the detection result of the temperature sensor 40. By performing such output control of the heater 25, a temperature (fixing temperature) of the fixing belt 21 can be adjusted and controlled to a desired temperature (control target temperature).

In addition, the pressure roller 31 serving as a pressure rotator mainly includes a cored bar 32 and an elastic layer 33 (the layer thickness is set to be relatively thick.) formed on the outer circumferential face of the cored bar 32 via an adhesion layer. The elastic layer 33 of the pressure roller 31 is made of solid rubber material such as fluorine-containing rubber and silicone rubber. In addition, the pressure roller 31 is pressed against the fixing assist roller 22 via the fixing belt 21. In this manner, a desired nip (fixing nip) is formed between the pressure roller 31 and the fixing belt 21. In addition, a thin release layer made of PFA or the like can be provided on the surface layer of the elastic layer 33. In addition, a cleaning roller impregnated with silicone oil or the like can be brought into slidingly contact with the outer circumferential face of the pressure roller 31.

Referring to FIG. 2, the entry guide plate 34 for guiding the conveyance of the recording medium P toward the nip is disposed on the entry side of a contact portion (corresponds to a nip.) of the fixing belt 21 and the pressure roller 31. In addition, the exit guide plate 35 for guiding the conveyance of the recording medium P fed from the nip is disposed on the exit side of the nip of the fixing belt 21 and the pressure roller 31 (position in a conveyance direction downstream side with respect to the nip).

Figure 3:
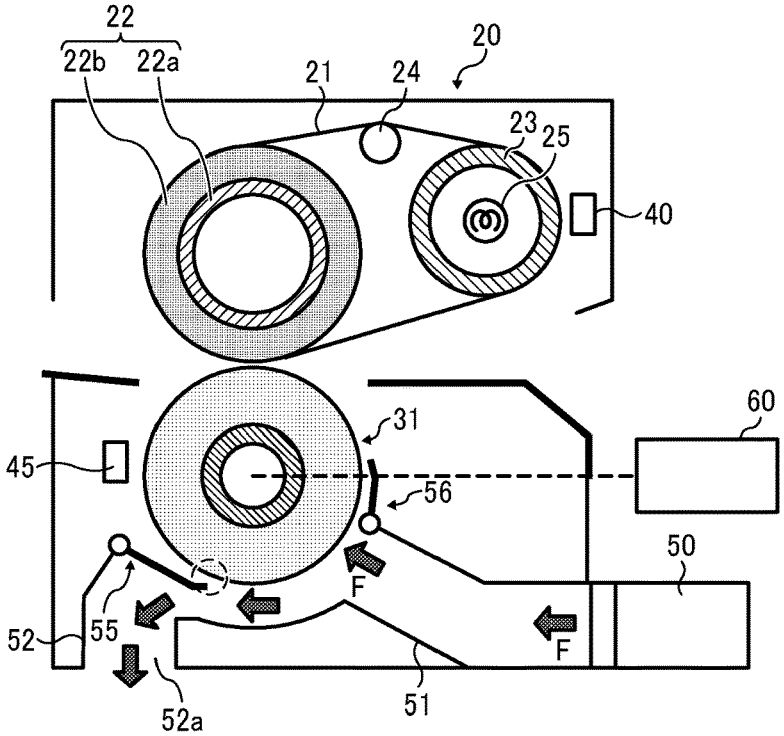
FIG. 3 is a diagram illustrating a state in which a pressure roller is separated from a fixing belt according to an embodiment of the present disclosure.

Referring to FIG. 3, the moving assembly 60 (contact-separation mechanism) moves the pressure roller 31 (pressure rotator) in directions to approach and move away from the fixing belt 21 (fixing rotator) (correspond to directions indicated by arrow C in FIG. 2.). More specifically, by operating the moving assembly 60, the pressure roller 31 is brought into contact with the fixing belt 21 (the fixing assist roller 22) at a predetermined nipping pressure as illustrated in FIG. 2, so as to form a desired nip for performing the fixing step, or the pressure roller 31 is separated from the fixing belt 21 (the fixing assist roller 22) as illustrated in FIG. 3 (or a nipping pressure is decreased). An operation of separating the pressure roller 31 (or operation of decreasing a nipping pressure) as illustrated in FIG. 3 is performed while image formation is not performed (while the fixing step is not performed). More specifically, the moving assembly 60 is controlled to bring the pressure roller 31 into a contact state as illustrated in FIG. 2, while the image formation is performed (while the fixing step is performed), and to bring the pressure roller 31 into a separated state as illustrated in FIG. 3, while the image formation is not performed (while the fixing step is not performed). As the moving assembly 60 (contact-separation mechanism) operating in the above-described manner, a known assembly can be used. For example, an assembly using a cam assembly that vertically moves the pressure roller 31 by motor driving controlled by a controller. With the above-described configuration and operation, the following failure can be prevented. More specifically, if the contact state of the pressure roller 31 continues for a long time in a state in which the operation of the fixing device 20 is stopped, permanent distortion is generated in the elastic layer 22*b* of the fixing assist roller 22, and the elastic layer 33 of the pressure roller 31. Such a failure can be prevented. In addition, the cooling assembly 500, the air regulation plates 55 and 56, and the temperature sensor 45 (temperature detector) for the pressure roller 31 are installed in the fixing device 20 in the present embodiment. These members will be described in detail later.

An operation of the fixing device 20 that is performed in normal sheet passage will be described below. If a power switch of the apparatus body 1 is input, alternating current voltage is applied (power is supplied) from the power source to the heater 25, and the fixing assist roller 22 is driven by the drive motor to rotate. As a result, by friction resistance between the members, the fixing belt 21, the heating roller 23, and the pressure roller 31 rotate (are driven to move) in the respective directions indicated by arrows B, D, and E in FIG. 2. Then, the recording medium P is fed from the sheet feeding device 7, and at the position of the secondary transfer bias roller 18, the toner image is borne on the recording medium P as an unfixed image. The recording medium P on which the unfixed image (toner image) is borne is conveyed in a direction indicated by arrow PD in FIG. 2, and fed into the nip of the fixing belt 21 and the pressure roller 31 that are in a pressed state. Then, through the heating by the fixing belt 21 and by the pressing force of the fixing belt 21 (the fixing assist roller 22) and the pressure roller 31, the toner image is fixed onto the surface of the recording medium P. Then, the recording medium P fed out from the nip by the rotating fixing belt 21 and the pressure roller 31 is conveyed in the direction indicated by arrow PD while being guided by the exit guide plate 35.

Characteristic configuration and operation of the fixing device 20 in the present embodiment will be described below. Referring to FIGS. 2, 3, and the like, the fixing device 20 in the present embodiment is provided with the cooling assembly 500 to cool (air-cool) the outer circumferential face of the pressure roller 31 (pressure rotator) by blowing air onto the outer circumferential face of the pressure roller 31 (pressure rotator). As illustrated in FIGS. 2 and 3, these cooling assemblies include a blower 50, a duct 51 (cooling duct), an exhaust duct 52, and the like. The blower 50 sucks in air from the outside of the fixing device 20. The duct 51 is connected to a discharge port for discharging the sucked air. The duct 51 is formed to directly blow the air discharged from the blower 50, onto the outer circumferential face (corresponds to the surface on the diagonally downward right in FIGS. 2 and 3) of the pressure roller 31 so that the air subsequently flows along the outer circumferential face (surface) of the pressure roller 31 toward the left side in FIGS. 2 and 3. In addition, the exhaust duct 52 is formed to exhaust the air having flowed along the duct 51, from an exhaust port 52*a* formed on the downside of the fixing device 20. In other words, the cooling assembly 500 causes air to flow in a direction indicated by arrow F in FIGS. 2 and 3, to air-cool the pressure roller 31 so that the surface temperature of the pressure roller 31 does not excessively rise.

In this manner, in the present embodiment, because the outer circumferential face (surface) of the pressure roller 31 is air-cooled by providing the cooling assembly 500, such a failure that a surface temperature rise of the pressure roller 31 generates a hot offset image, or heat expansion or heat deterioration of the pressure roller 31 is caused can be reliably reduced. In particular, in the present embodiment, even if an envelope is passed as the recording medium P, the layer thickness of the elastic layer 33 of the pressure roller 31 is set to be relatively thick so as not to cause a fold or misalignment in the recording medium P (envelope), and the pressure roller 31 has a thermally expandable configuration. Thus, the cooling performed by the cooling assembly 500 is useful. In addition, in the present embodiment, the cooling assembly 500 is formed to be able to air-cool the pressure roller 31 even when the pressure roller 31 is in the separated state (corresponds to the state in FIG. 3.), in addition to the time when the pressure roller 31 is in the contact state (corresponds to the state in FIG. 2.). This enables air cooling control with higher flexibility. For example, in the separated state, when the temperature sensor 45 determines that the temperature of the pressure roller 31 is larger than a predetermined value and a good fixing step is not to be performed, before the image formation (fixing step) is performed, the cooling assembly 500 can be controlled to air-cool the pressure roller 31 even in the separated state.

Figure 4:
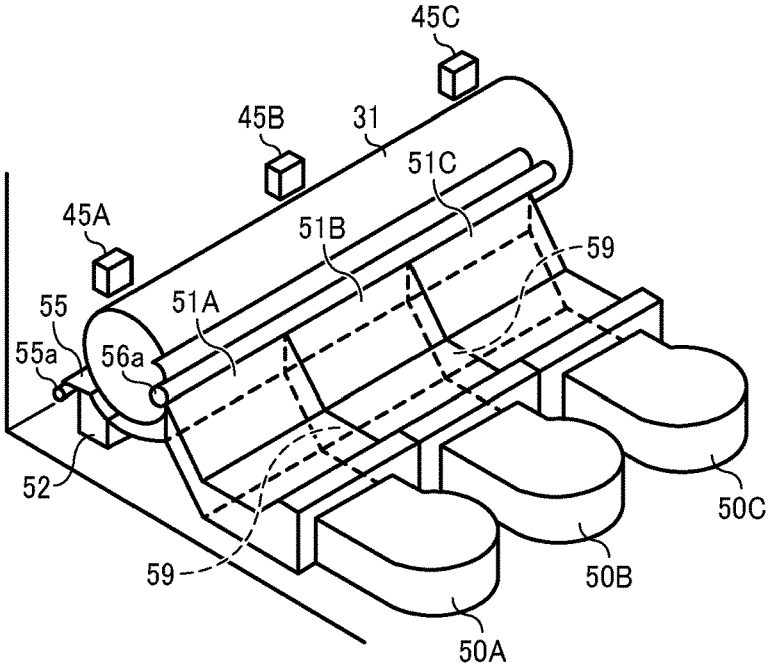
FIG. 4 is a perspective view illustrating cooling assemblies according to an embodiment of the present disclosure.

Here, in the present embodiment, as illustrated in FIG. 4, the cooling assembly 500 is formed to be able to separately cool a plurality of locations in a width direction (corresponds to a direction vertical to a sheet face on which FIGS. 2 and 3 are printed, and to a rotation axis direction of the pressure roller 31.) of the pressure roller 31. In addition, the temperature sensor 45 serving as a temperature detector for detecting the surface temperature of the pressure roller 31 is also formed to be able to separately detect temperatures in a plurality of locations in the width direction of the pressure roller 31.

Specifically, referring to FIG. 4, the fixing device 20 in the present embodiment is provided with temperature sensors 45A to 45C serving as a plurality of temperature detectors for detecting the surface temperatures of the pressure roller 31 (pressure rotator) in a plurality of locations (3 locations in the present embodiment.) in the width direction. More specifically, these temperature sensors 45A to 45C are thermopiles opposing the surface of the pressure roller 31 in a non-contact manner, and the first temperature sensor 45A detects a temperature at one end side in the width direction of the pressure roller 31, the second temperature sensor 45B detects a temperature at a central part in the width direction of the pressure roller 31, and the third temperature sensor 45C detects a temperature at the other end side in the width direction of the pressure roller 31.

Then, referring to FIG. 4, the cooling assemblies are formed to be able to separately blow air onto a plurality of locations in the width direction on the surface of the pressure roller 31 that correspond to the installation positions of the plurality of temperature sensors 45A to 45C, based on the detection result of the above-described plurality of temperature sensors 45A to 45C (temperature detectors). More specifically, referring to FIG. 4, a first blower 50A discharges air sucked in from the outside, to a first duct 51A (isolated by a partition 59 from a neighboring second duct 51B.), so that the air is blown onto the one end side in the width direction of the pressure roller 31 via the first duct 51A. In a similar manner, a second blower 50B discharges air sucked in from the outside, to the second duct 51B (isolated by the partition 59 from neighboring first and third ducts 51A and 51C.), so that the air is blown onto the central part in the width direction of the pressure roller 31 via the second duct 51B. In a similar manner, a third blower 50C discharges air sucked in from the outside, to the third duct 51C (isolated by the partition 59 from the neighboring second duct 51B.), so that the air is blown onto the other end side in the width direction of the pressure roller 31 via the third duct 51C.

Then, if the first temperature sensor 45A detects a state in which the temperature at the one end side in the width direction of the pressure roller 31 is equal to or larger than the predetermined value, it is determined that a good fixing step is not to be performed in the state, and the first blower 50A is operated until the detected temperature falls below the predetermined value. In a similar manner, if the second temperature sensor 45B detects a state in which the temperature at the central part in the width direction of the pressure roller 31 is equal to or larger than the predetermined value, it is determined that a good fixing step is not to be performed in the state, and the second blower 50B is operated until the detected temperature falls below the predetermined value. In a similar manner, if the third temperature sensor 45C detects a state in which the temperature at the other end side in the width direction of the pressure roller 31 is equal to or larger than the predetermined value, it is determined that a good fixing step is not to be performed in the state, and the third blower 50C is operated until the detected temperature falls below the predetermined value. With such configuration and operation, even if a part in the width direction of the pressure roller 31 locally rises in temperature too much, such a state can be resolved, and the surface temperature of the pressure roller 31 can be uniformized in the width direction. For example, when a small-sized sheet (corresponds to the recording medium P of which both ends in the width direction of the pressure roller 31 become non-sheet-passage areas.) is continuously passed, because the heat transfer onto the recording medium P does not occur in the non-sheet-passage areas, only the both ends in the width direction of the pressure roller 31 easily rise in temperature too much. Nevertheless, by air-cooling the both ends in the width direction of the pressure roller 31 by operating the first and third blowers 50A and 50C, such a failure can be prevented. In addition, the number of the blowers 50 and the number of the temperature sensors 45 are not limited to 3 in the present embodiment, and can be increased or decreased according to the number of width direction sizes of the recording medium P that can be passed.

Figure 5:
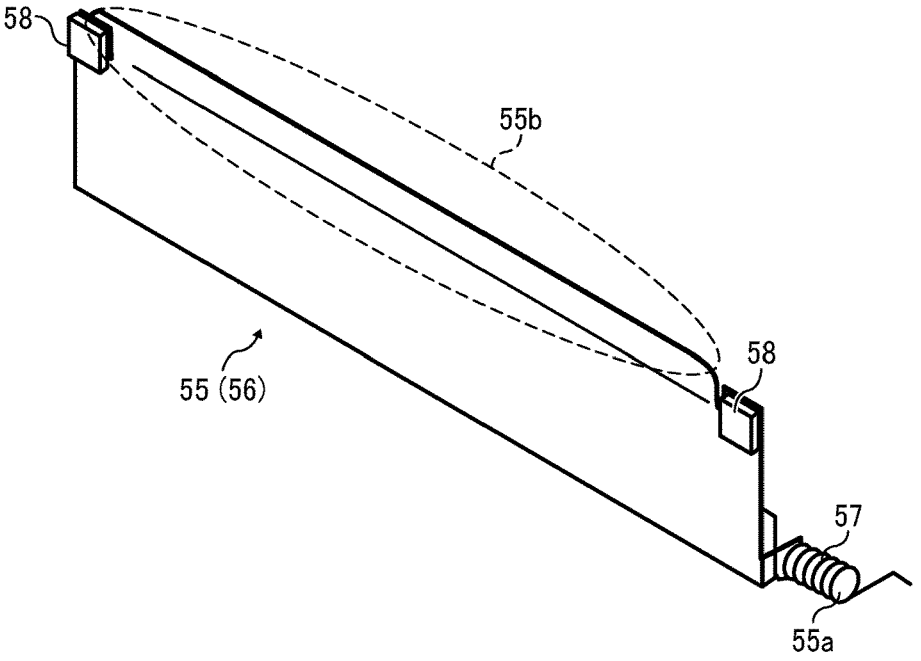
FIG. 5 is a perspective view illustrating an air regulation plate according to an embodiment of the present disclosure.

Here, referring to FIGS. 2, 3, and the like, the fixing device 20 in the present embodiment is provided with the first air regulation plate 55 (first air regulation plate) for regulating (controlling) a flow direction or an amount of air that has been blown onto the outer circumferential face of the pressure roller 31 (pressure rotator), and the second air regulation plate 56 (second air regulation plate) for regulating a flow direction or an amount of air that has not been blown onto the outer circumferential face of the pressure roller 31, each as a part of the cooling assemblies. Referring to FIG. 5, and the like, both of these air regulation plates 55 and 56 are substantially plate-like members made of metal material or resin material having a heat resistance property. The first air regulation plate 55 is formed to oppose a position where air that has been discharged from the blower 50 and has passed through the duct 51 is directly blown onto the surface of the pressure roller 31, with a fine clearance G (can refer to FIGS. 6A and 6B.) in a position on a rotation direction upstream side of the pressure roller 31 (corresponds to a position on a diagonally downward left of the pressure roller 31 in FIGS. 2 and 3.), so as not to generate a clearance between the duct 51 and the exhaust duct 52. By providing the air regulation plate 55 in this manner, the air that has been blown onto the surface of the pressure roller 31 is smoothly guided to the exhaust duct 52 along the flow indicated by arrow F in FIGS. 2 and 3, to be effectively exhausted from the exhaust port 52*a*, with hardly leaking from portions between the duct 51, the exhaust duct 52, and the pressure roller 31. In particular, the air flowing along the surface of the pressure roller 31 is changed in the flow direction by the air regulation plate 55 so as to move away from the surface. The second air regulation plate 56 is formed to oppose the pressure roller 31 with a fine clearance in the vicinity of the position where air that has been discharged from the blower 50 and has passed through the duct 51 is directly blown onto the surface of the pressure roller 31, so as not to generate a clearance between the duct 51. By providing the second air regulation plate 56 in this manner, the air that has not been blown onto the surface of the pressure roller 31 smoothly flows along the flow indicated by arrow F in FIGS. 2 and 3, with hardly leaking from a portion between the duct 51 and the pressure roller 31.

As described above, the air regulation plates 55 and 56 are both formed to oppose the outer circumferential face of the pressure roller 31 with the fine clearance G (can also refer to FIGS. 6A and 6B.) between itself and the outer circumferential face of the pressure roller 31 (pressure rotator). Specifically, referring to FIGS. 5, 6A, 6B, and the like, in a leading end 55*b* or 56*b* of the air regulation plate 55 or 56, contact members 58 are installed in the respective positions at both ends in the width direction that correspond to the non-sheet-passage areas (correspond to the areas on the outside of a sheet passage area M with the sheet-passable maximum size.). Then, the air regulation plates 55 and 56 are formed to contact the pressure roller 31 (pressure rotator) in these positions via the contact members 58. At least contact faces (corresponds to the faces that slidingly contact the pressure roller 31.) of the contact members 58 are preferably made of low friction material having a heat resistance property. Specifically, in the present embodiment, the contact members 58 are made of PFA material. This reduces friction resistance arising between the pressure roller 31 and the contact members 58. Thus, such a failure that the pressure roller 31 and the contact members 58 become worn and deteriorated with time can be reliably reduced. In addition, because the contact members 58 are formed to contact the non-sheet-passage areas of the pressure roller 31, even if the contact portions of the pressure roller 31 become worn and deteriorated by the slidingly contact with the contact members 58, this does not affect the conveyance property and fixing property of the recording medium P. In this manner, in the present embodiment, the air regulation plates 55 and 56 are formed so that the leading ends 55*b* and 56*b* of the air regulation plates 55 and 56 do not directly contact the pressure roller 31. Such a configuration prevents a failure that the slidingly contact of the pressure roller 31 and the air regulation plates 55 and 56 causes the pressure roller 31 and the air regulation plates 55 and 56 to become worn and deteriorated with time.

In addition, the air regulation plates 55 and 56 are both formed to oppose the outer circumferential face of the pressure roller 31 with a clearance equivalent to the above-described clearance G, in accordance with an operation of moving the pressure roller 31 in the directions (correspond to the directions indicated by arrow C in FIG. 2.) to approach and move away from the fixing belt 21 that is performed by the moving assembly 60. In other words, the air regulation plates 55 and 56 are formed to always contact the pressure roller 31 via the contact members 58 in conjunction with the vertical movement of the pressure roller 31 that is caused by the moving assembly 60, even when the pressure roller 31 is in the contact state as illustrated in FIG. 2, or even when the pressure roller 31 is in the separated state as illustrated in FIG. 3.

Specifically, the air regulation plate 55 or 56 is held on a housing of the fixing device 20 so as to be rotatable in the clockwise direction and the counterclockwise direction in FIGS. 2 and 3 around rotation shafts 55*a* or 56*a* respectively formed on the both ends in the width direction of the trailing end. In addition, referring to FIG. 5, a torsion coil spring 57 (an arm on one end side is hooked to the air regulation plate 55 or 56, and an arm on the other end side is hooked to the housing of the device.) is winded around the rotation shaft 55*a* (56*a*) of the air regulation plate 55 (56). The torsion coil spring 57 biases the air regulation plate 55 (56) so as to rotate the air regulation plate 55 (56) in the counterclockwise direction in FIGS. 2 and 3 (corresponds to a direction in which the air regulation plate 55 (56) contacts the pressure roller 31.). In addition, a biasing force applied by this torsion coil spring 57 is set to be sufficiently smaller than a force for moving the pressure roller 31 in the direction to move away from the fixing belt 21 that is applied by the moving assembly 60.

Here, in the present embodiment, these air regulation plates 55 and 56 are both formed so that the respective leading ends 55*b* and 56*b* opposing the outer circumferential face of the pressure roller 31 (pressure rotator) follow the shape of the outer circumferential face of the pressure roller 31. Specifically, referring to FIGS. 5, 6B, and the like, the respective leading ends 55*b* and 56*b* of the air regulation plates 55 and 56 are formed in a curved surface shape according to the curvature of the outer circumferential face of the pressure roller 31. In other words, the curvature of the leading ends 55*b* and 56*b* formed in an R-shape in the air regulation plates 55 and 56 is set to be a value equivalent to or approximate to the curvature of the outer diameter of the pressure roller 31. In addition, the leading ends 55*b* and 56*b* are formed to be curved so that the fine clearances G between the pressure roller 31 and the leading ends 55*b* and 56*b* are substantially-equally maintained in a predetermined range set along the circumferential direction of the pressure roller 31.

By providing the air regulation plates 55 and 56 having such a configuration, the following failures can be reliably reduced. More specifically, air that has been blown onto the outer circumferential face of the pressure roller 31, or air that has not been blown onto the outer circumferential face of the pressure roller 31 uniformly flows in an unintended direction (e.g., an exit side or entry side of the nip.), so that the conveyance property of the recording medium P is affected, other members not to be cooled (e.g., the fixing belt 21 and the temperature sensors 45A to 45C.) are cooled, or the pressure roller 31 fails to be efficiently cooled without unevenness in the width direction. Such failures can be reliably reduced. Because the leading ends 55*b* and 56*b* of the air regulation plates 55 and 56 are curved so as to follow the outer circumferential face of the pressure roller 31, as compared with a case in which the leading ends 55*b* and 56*b* are linearly formed without being curved, the fine clearances G between the pressure roller 31 and the leading ends 55*b* and 56*b* of the air regulation plates 55 and 56 are uniformized also in the width direction, in addition to being uniformized in the predetermined range in the circumferential direction. Thus, even if air leaks from the fine clearance G between the pressure roller 31 and the leading end 55*b* or 56*b*, the amount of the leaked air becomes substantially uniform in the width direction, so that a large amount of air does not locally leak from a part (e.g., central part.) in the width direction. For example, this can prevent such a failure that air leaks ununiformly in the width direction from the clearance G of the leading end 55*b* of the first air regulation plate 55, and the air is intensively blown onto one (e.g., the temperature sensor 45B at the central part.) of the 3 temperature sensors 45A to 45C that are disposed side by side in the width direction, so that cooling control accuracy of the temperature sensor decreases, and cooling control with low accuracy is performed as a whole. In addition, because the leading ends 55*b* and 56*b* of the air regulation plates 55 and 56 are formed so as to follow the outer circumferential face of the pressure roller 31, even if the leading ends 55*b* and 56*b* contact the rotating pressure roller 31, the outer circumferential face of the pressure roller 31 is difficult to be damaged.

In addition, referring to FIGS. 2, 3, and the like, the air regulation plates 55 and 56 are disposed so that the leading ends 55*b* and 56*b* are positioned on the rotation direction downstream sides of the pressure roller 31, with opposing the outer circumferential face of the pressure roller 31 so as to gradually decrease distances opposing the pressure roller 31, toward the leading ends 55*b* and 56*b*. In other words, the air regulation plates 55 and 56 are disposed so that the sides of the rotation shafts 55*a* and 56*a* are positioned on the rotation direction upstream side of the pressure roller 31, and the leading ends 55*b* and 56*b* are positioned on the rotation direction downstream sides of the pressure roller 31, and disposed so that gaps with the pressure roller 31 gradually decrease from the sides of the rotation shafts 55*a* and 56*a* toward the leading ends 55*b* and 56*b*. By having such a configuration, it becomes easier to ensure the fine clearances G of the leading ends 55*b* and 56*b*. In addition, even if the leading ends 55*b* and 56*b* contact the rotating pressure roller 31, the air regulation plates 55 and 56 can easily rotate around the rotation shafts 55*a* and 56*a*, so that the outer circumferential face of the pressure roller 31 is difficult to be damaged.

<Variation>

Figure 6A:
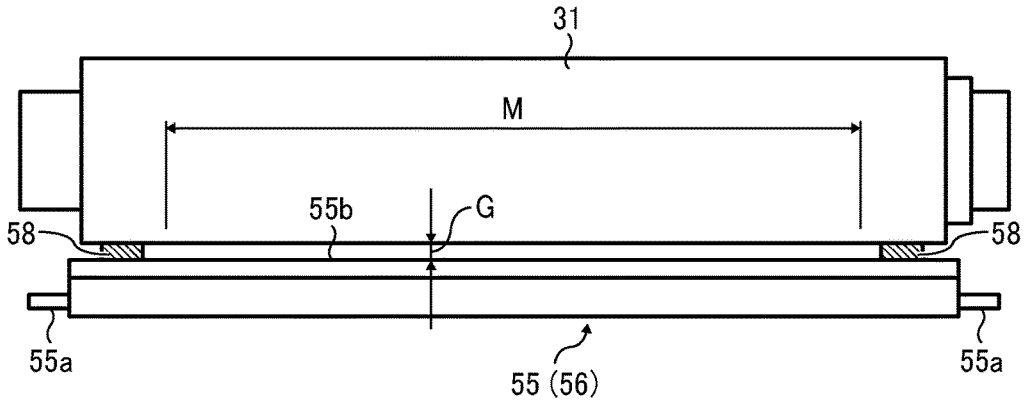
FIG. 6A is a schematic view illustrating the pressure roller and the air regulation plate in a width direction, according to an embodiment of the present disclosure.
Figure 6B:
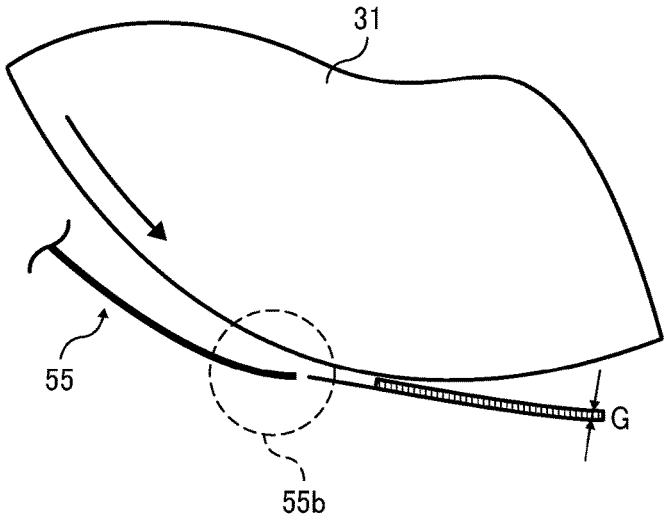
FIG. 6B is an enlarged view illustrating a vicinity of a leading end of the air regulation plate according to an embodiment of the present disclosure.
Figure 7A:
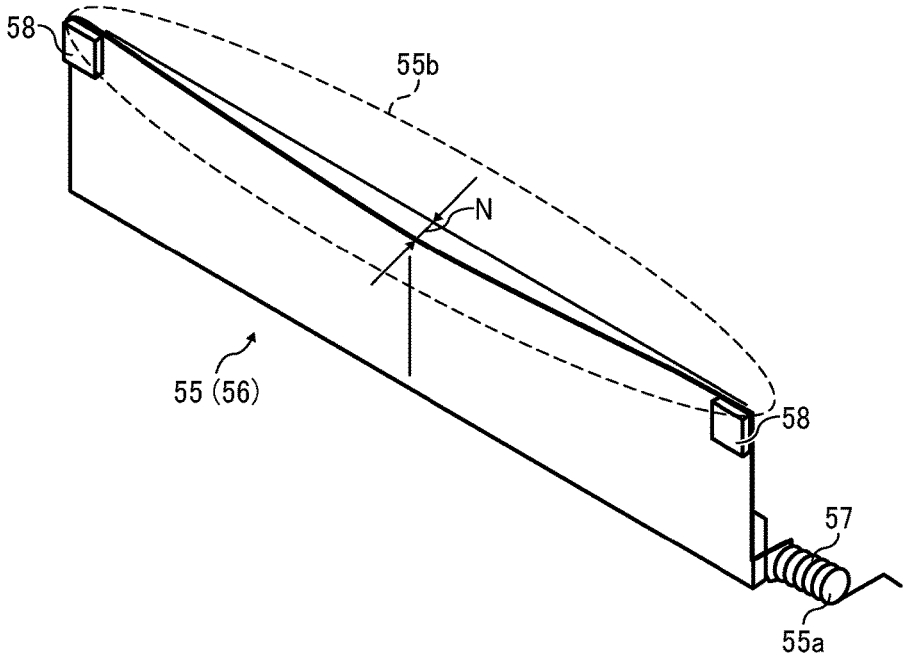
FIG. 7A is a perspective view illustrating an air regulation plate in a fixing device serving as a variation.
Figure 7B:
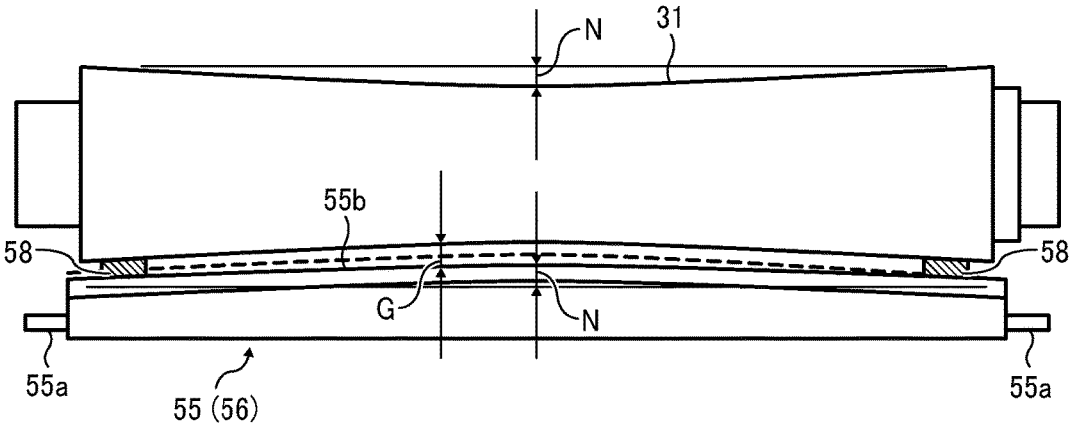
FIG. 7B is a schematic view illustrating a pressure roller and the air regulation plate in a width direction, in the fixing device serving as a variation.

FIG. 7A is a perspective view illustrating air regulation plates 55 and 56 in a fixing device 20 serving as a variation, and is a diagram corresponding to FIG. 5 in the present embodiment. In addition, FIG. 7B is a schematic view illustrating the pressure roller 31 and the air regulation plates 55 and 56 in the width direction, in the fixing device 20 serving as a variation, and is a diagram corresponding to FIG. 6A in the present embodiment. In addition, similarly to FIG. 6A, FIG. 7B is a diagram illustrating a position where the leading end 55*b* or 56*b* of the air regulation plate 55 or 56 opposes the pressure roller 31, viewed in a tangential direction. As illustrated in FIG. 7B, the pressure roller 31 (pressure rotator) in the variation is formed in a Japanese hand drum (Tsuzumi) shape in the rotation axis direction. In other words, the pressure roller 31 is formed so that the outer diameter gradually decreases from the both ends in the width direction toward the central part in the width direction. In the present embodiment, a deflection amount N (corresponds to a radius difference between the maximum outer diameter portion and the minimum outer diameter portion.) of the pressure roller 31 is set to be equivalent to a known amount. Then, also in this variation, the air regulation plates 55 and 56 are formed so that the leading ends 55*b* and 56*b* opposing the outer circumferential face of the pressure roller 31 follow the shape of the outer circumferential face of the pressure roller 31. Specifically, in the variation, the air regulation plates 55 and 56 are formed so that the leading ends 55*b* and 56*b* have an inverted V-shape in the rotation axis direction (width direction) according to the Japanese hand drum shape of the pressure roller 31. Specifically, as illustrated in FIGS. 7A and 7B, the leading end 55*b* or 56*b* of the air regulation plate 55 or 56 is formed in an inverted V-shape so that the central part in the width direction projects by the same amount (distance) as the deflection amount N as compared with the both ends in the width direction, according to the deflection amount N of the pressure roller 31, so as to form a desired clearance G in the width direction from the pressure roller 31 formed in the Japanese hand drum shape. Even in the case of having such a configuration, an effect similar to that in the present embodiment can be obtained. In addition, in this variation, the leading ends 55*b* and 56*b* of the air regulation plates 55 and 56 are formed in the inverted V-shape in the rotation axis direction according to the Japanese hand drum shape of the pressure roller 31. Alternatively, as indicated by a broken line in FIG. 7B, the leading ends 55*b* and 56*b* can be formed in an inverted U-shape in the rotation axis direction according to the Japanese hand drum shape of the pressure roller 31.

As described above, the fixing device 20 in the present embodiment is provided with the cooling assembly 500 to cool the outer circumferential face of the pressure roller 31 (pressure rotator) by blowing air onto the outer circumferential face of the pressure roller 31 (pressure rotator), and the air regulation plates 55 and 56 for regulating a flow direction or an amount of air that has not been blown onto the outer circumferential face of the pressure roller 31, or air that has been blown onto the outer circumferential face. In addition, the air regulation plates 55 and 56 are formed so that the leading ends 55*b* and 56*b* opposing the outer circumferential face of the pressure roller 31 with clearances follow the shape of the outer circumferential face of the pressure roller 31. With this configuration, the following failures can be made difficult to be caused. More specifically, air that has been blown onto the outer circumferential face of the pressure roller 31, or air that has not been blown onto the outer circumferential face of the pressure roller 31 uniformly flows in an unintended direction, so that the conveyance property of the recording medium P is affected, other members not to be air-cooled are air-cooled, or the pressure roller 31 fails to be efficiently air-cooled without unevenness. Such failures can be made difficult to be caused.

In addition, in the present embodiment, the pressure roller 31 is used as a pressure rotator. Alternatively, a pressure belt may be used as a pressure rotator. In addition, in the present embodiment, the fixing belt 21 is used as a fixing rotator. Alternatively, a fixing roller may be used as a fixing rotator. Furthermore, in the present embodiment, the heater 25 is used as a heater for heating a fixing rotator. Alternatively, an excitation coil (heater compatible with an electromagnetic induction heating type fixing device.) can be used as a heater for heating a fixing rotator, or a resistance heat generator can be used as a heater. In addition, also in these cases, an effect substantially similar to that in the present embodiment can be obtained.

In addition, in the present embodiment, the air regulation plate 55 for regulating a flow direction or an amount of air that has been blown onto the outer circumferential face of the pressure roller 31, and the air regulation plate 56 for regulating a flow direction or an amount of air that has not been blown onto the outer circumferential face of the pressure roller 31 are installed, and the present disclosure is applied to both of the air regulation plates 55 and 56. In contrast to this, the present disclosure can be applied to either one of these 2 air regulation plates 55 and 56, or only either one of the 2 air regulation plates 55 and 56 can be installed, and the present disclosure can be applied thereto. In addition, in such a case, an effect substantially similar to that in the present embodiment can be obtained.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims. The number, the position, the shape, and the like that are preferable for practicing the present disclosure can be employed.

What is claimed is:

1. A fixing device comprising:

a fixing rotator to heat a toner image and fix the toner image on a recording medium;

a pressure rotator pressed against the fixing rotator to form a nip between the pressure rotator and the fixing rotator, to which the recording medium is conveyed;

a cooling assembly to blow air onto an outer circumferential face of the pressure rotator to cool the outer circumferential face of the pressure rotator; and an air regulation plate disposed opposing the outer circumferential face of the pressure rotator with a clearance between the air regulation plate and the outer circumferential face of the pressure rotator, to regulate a flow direction or amount of one of air to be blown onto the outer circumferential face of the pressure rotator and air having been blown onto the outer circumferential face of the pressure rotator, the air regulation plate having a leading end opposing the outer circumferential face of the pressure rotator, the leading end having a curved shape following a curvature of the outer circumferential face of the pressure rotator, wherein the pressure rotator has a shape in which an outer diameter gradually decreases from both ends toward a center in a rotation axis direction of the pressure rotator, and wherein the shape of the leading end of the air regulation plate is a U-shape or a V-shape in the rotation axis direction according to the shape of the pressure rotator.

2. The fixing device according to claim 1, wherein the shape of the leading end of the air regulation plate is a curved shape according to a curvature of the outer circumferential face of the pressure rotator.

3. The fixing device according to claim 1, wherein the air regulation plate has contact members at respective positions of both ends in a width direction of the air regulation plate that correspond to non-sheet-passage areas of the pressure rotator in the leading end, and wherein the air regulation plate is disposed to contact the pressure rotator via the contact members at the positions.

4. The fixing device according to claim 1, further comprising a plurality of temperature detectors to detect surface temperatures of the pressure rotator in a plurality of locations in a width direction of the pressure rotator, wherein the cooling assembly separately blows air onto a plurality of locations in the width direction on a surface of the pressure rotator that corresponds to installation positions of the plurality of temperature detectors, based on a detection result of the plurality of temperature detectors.

5. An image forming apparatus comprising the fixing device according to claim 1.

6. A fixing device comprising:

a fixing rotator to heat a toner image and fix the toner image on a recording medium;

a pressure rotator pressed against the fixing rotator to form a nip between the pressure rotator and the fixing rotator, to which the recording medium is conveyed;

a cooling assembly to blow air onto an outer circumferential face of the pressure rotator to cool the outer circumferential face of the pressure rotator; and an air regulation plate disposed opposing the outer circumferential face of the pressure rotator with a clearance between the air regulation plate and the outer circumferential face of the pressure rotator, to regulate a flow direction or amount of one of air to be blown onto the outer circumferential face of the pressure rotator and air having been blown onto the outer circumferential face of the pressure rotator, the air regulation plate having a leading end opposing the outer circumferential face of the pressure rotator, the leading end having a curved shape following a curvature of the outer circumferential face of the pressure rotator, the fixing device further comprising a moving assembly to move the pressure rotator close to or away from the fixing rotator, wherein the air regulation plate moves with an operation of moving the pressure rotator close to or away from the fixing rotator with the moving assembly, to oppose the outer circumferential face of the pressure rotator with a clearance equivalent to the clearance, in accordance.

7. A fixing device comprising:

a fixing rotator to heat a toner image and fix the toner image on a recording medium;

a pressure rotator pressed against the fixing rotator to form a nip between the pressure rotator and the fixing rotator, to which the recording medium is conveyed;

a cooling assembly to blow air onto an outer circumferential face of the pressure rotator to cool the outer circumferential face of the pressure rotator; and an air regulation plate disposed opposing the outer circumferential face of the pressure rotator with a clearance between the air regulation plate and the outer circumferential face of the pressure rotator, to regulate a flow direction or amount of one of air to be blown onto the outer circumferential face of the pressure rotator and air having been blown onto the outer circumferential face of the pressure rotator, the air regulation plate having a leading end opposing the outer circumferential face of the pressure rotator, the leading end having a curved shape following a curvature of the outer circumferential face of the pressure rotator, wherein the air regulation plate is disposed so that, the air regulation plate is disposed opposing the outer circumferential face of the pressure rotator so that an opposing distance between the air regulation plate and the pressure rotator gradually decreases toward the leading end and the leading end is positioned downstream from the pressure rotator in a rotation direction of the pressure rotator.

* * * * *